US011825995B2

(12) United States Patent
Bentkovski

(10) Patent No.: US 11,825,995 B2
(45) Date of Patent: Nov. 28, 2023

(54) DISPENSING MONITORING SYSTEM AND METHOD

(71) Applicant: WATERIO LTD., Ness Ziona (IL)

(72) Inventor: Yakov Bentkovski, Ness Ziona (IL)

(73) Assignee: WATERIO LTD.

( * ) Notice: Subject to any disclaimer, the term of this patent is extended or adjusted under 35 U.S.C. 154(b) by 0 days.

(21) Appl. No.: 17/053,806

(22) PCT Filed: May 16, 2019

(86) PCT No.: PCT/IB2019/054078
§ 371 (c)(1),
(2) Date: Nov. 9, 2020

(87) PCT Pub. No.: WO2019/220397
PCT Pub. Date: Nov. 21, 2019

(65) Prior Publication Data

US 2021/0259483 A1 Aug. 26, 2021

Related U.S. Application Data

(60) Provisional application No. 62/672,234, filed on May 16, 2018.

(51) Int. Cl.
*A47K 5/12* (2006.01)
*G08B 21/24* (2006.01)

(52) U.S. Cl.
CPC ..... *A47K 5/1217* (2013.01); *A47K 5/1202* (2013.01); *G08B 21/245* (2013.01)

(58) Field of Classification Search
CPC ... A47K 5/1217; A47K 5/1202; G08B 21/245
See application file for complete search history.

(56) References Cited

U.S. PATENT DOCUMENTS

| | | | | |
|---|---|---|---|---|
| 6,360,181 | B1 | 3/2002 | Gemmell et al. | |
| 10,365,139 | B2 * | 7/2019 | Singh | A47K 5/1217 |
| 11,181,413 | B2 * | 11/2021 | Kobs | G01F 23/266 |
| 2010/0332022 | A1 * | 12/2010 | Wegelin | G16H 40/20 715/764 |
| 2017/0109689 | A1 * | 4/2017 | Lorkowski | G06Q 10/087 |
| 2017/0190565 | A1 * | 7/2017 | Proper | B67D 7/0288 |

* cited by examiner

*Primary Examiner* — Jeremy Carroll

(57) ABSTRACT

Disclosed is a dispensing system. The dispensing system includes a fluid container adapted to store a fluid, and having a predefined storage capacity; a memory unit having a plurality of instructions and information pertaining to the fluid contained in the fluid container, stored therein; a dispensing pump associated with the fluid container, the dispensing pump adapted to selectively dispense fluid from the fluid container; a sensor configured to detect dispensing of fluid from the fluid container; and a processing unit in communication with each of the sensor and the memory unit. The processing unit is adapted to process the set of instructions stored in the memory unit to determine quantity of fluid dispensed from the fluid container, upon receiving a signal from the sensor.

11 Claims, 3 Drawing Sheets

DISPENSING MONITORING SYSTEM AND METHOD

FIELD OF THE INVENTION

The present invention generally relates to fluid dispensing systems, and, more particularly, to a dispensing pump for monitoring product dispensing from a container.

BACKGROUND OF THE INVENTION

Frequent washing of hands is an important part of personal hygiene. In fact, the U.S. Center for Disease Control has stated that one of the most important things you can do to keep from getting sick is to wash your hands. However, many people, through lack of knowledge, poor habits or simple negligence, do not wash their hands frequently enough.

Because of the importance to overall health and the failure of many people to wash their hands frequently enough, various hand washing systems have been developed. Electronic soap dispensers including sensors for hand-free operation are known in the art. Such electronic soap dispensers may include infrared or capacitive sensors to detect the presence of a user hands and dispense soap in response thereto.

Further, electronic soap dispensers that include a controller to actuate a pump in response to input from a sensor are also known in the art. However, none of the existing pumps monitor the amount of product dispensed from the container. Monitoring of amount dispensed from the container allows to retrieve multiple information such as accurate usage of product, re-order, automatic re-ordering, refiling of container etc.

Accordingly, there exists a need of a system attached to a container that can monitor the amount of product dispensed from the container. Further, there exists a need of a system that can send notifications over a communication network to remind to use the product when near the container.

SUMMARY OF THE INVENTION

In view of the foregoing disadvantages inherent in the prior art, the general purpose of the present invention is to provide a dispensing system to include all advantages of the prior art, and to overcome the drawbacks inherent in the prior art.

In one aspect of the present invention, a dispensing system is provided. The dispensing system comprises a fluid container adapted to store a fluid, and having a predefined storage capacity. The dispensing system also comprises a memory unit having a plurality of instructions and information pertaining to the fluid contained in the fluid container, stored therein. The dispensing system further comprises a dispensing pump associated with the fluid container. The dispensing pump adapted to selectively dispense fluid from the fluid container. The dispensing system comprises a sensor configured to detect dispensing of fluid from the fluid container. Further, the sensor also detect a human pressing or activating of the dispensing pump. The dispensing system also comprises a processing unit in communication with each of the sensor and the memory unit. The processing unit is adapted to process the set of instructions stored in the memory unit to determine quantity of fluid dispensed from the container, upon receiving a signal from the sensor.

In an embodiment, the processing unit is adapted to calculate a current quantity of fluid in the container based on the comparison between the quantity of fluid dispensed from the fluid container and the quantity of fluid stored in the fluid container.

In an embodiment, the dispensing system comprises a communication unit, wherein the processing unit is adapted to process the set of instructions stored in the memory unit and send processed signals to the communication unit In an embodiment, the dispensing system comprises an output unit adapted to receive signals from the processing unit via the communication unit In an embodiment, the processed signals include instruction pertaining to replenishing the fluid into the fluid container.

In an embodiment, the processing unit is adapted measure passage of time upon receiving the signal from the sensor, and provide an output upon passage of a predetermined period of time, via the output unit.

In an embodiment, the output upon passage of the predetermined period of time, via the output unit, is one or more of audio output, visual output, and tactile output, or via the communication units In an embodiment, the dispensing system comprises a battery unit to provide power to the memory unit, the sensor, processing unit, and the communication unit. Further, the memory unit is also used for recording the pump use, quantity use, any notification from the output unit and generate a log for the same. The generated log can be sent using the communication unit.

In another aspect of the present invention, an auxiliary system of a dispensing system having a fluid container is provided. The dispensing pump comprises a memory unit having a plurality of instructions and information pertaining to the fluid contained in the fluid container. The dispensing pump also comprises a sensor configured to detect dispensing of fluid from the fluid container. The dispensing pump further comprises a processing unit in communication with each of the sensor and the memory unit. The processing unit is adapted to process the set of instructions stored in the memory unit to determine quantity of fluid dispensed from the container, upon receiving a signal from the sensor.

In an embodiment, the processing unit is adapted to calculate a current quantity of fluid in the container based on the comparison between the quantity of fluid dispensed from the fluid container and the quantity of fluid stored in the fluid container. In another way, the processing unit is adapted to calculate the last replenishment time of the fluid in the container.

In an embodiment, the dispensing pump comprises a communication unit. The processing unit is adapted to process the set of instructions stored in the memory unit and send processed signals to the communication unit.

In an embodiment, the dispensing pump comprises an output unit adapted to receive signals received from the processing unit via the communication unit.

In an embodiment, the processed signals include instruction pertaining to replenishing the fluid into the fluid container.

In an embodiment, the processing unit is adapted measure passage of time upon receiving the signal from the sensor, and provide an output upon passage of a predetermined period of time, via the output unit.

In an embodiment, the output upon passage of the predetermined period of time, via the output unit, is one or more of audio output, visual output, and tactile output.

In an embodiment, the dispensing pump comprises a battery unit to provide power to the memory unit, the sensor, processing unit, and the communication unit.

In yet another aspect of the present invention, a method of dispensing fluid from a dispensing system is provided. The method comprises detecting via a sensor, dispensing of fluid from a fluid container. The method also comprises calculating, via a processing unit, an amount of the fluid dispensed from the fluid container, and an amount of time passed since dispensing of fluid from the fluid container. The method further comprises communicating, via a communication unit, the calculated amount of fluid dispensed from the fluid container to the output unit.

In an embodiment, the method comprises comparing the calculated amount of fluid dispensed from the fluid container with the predefined storage capacity of the fluid container to determine an amount of fluid left in the fluid container.

In an embodiment, the method also comprises communicating, via the communication unit, the determined amount of fluid left in the fluid container.

In an embodiment, the method further comprises providing an output after passage of a predetermined duration of time since dispensing of fluid from the fluid container.

This together with the other aspects of the present invention, along with the various features of novelty that characterize the present invention, is pointed out with particularity in the claims annexed hereto and forms a part of the present invention. For a better understanding of the present invention, its operating advantages, and the specified object attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The terms, "a" and "an" herein do not denote a limitation of quantity, but rather denote the presence of at least one of the referenced items.

The present invention provides a dispensing system. The dispensing system includes a fluid container adapted to store a fluid, and having a predefined storage capacity, and a memory unit having a plurality of instructions and information pertaining to the fluid contained in the fluid container, stored therein. The dispensing system further includes a dispensing pump associated with the fluid container, the dispensing pump adapted to selectively dispense fluid from the fluid container; a sensor configured to detect dispensing of fluid from the fluid container and human pressing or activating of the dispensing pump; and a processing unit in communication with each of the sensor and the memory unit. The processing unit is adapted to process the set of instructions stored in the memory unit to determine quantity of fluid dispensed from the container, upon receiving a signal from the sensor.

In yet another embodiment, the dispensing system further includes a fluid container adapted to store a fluid, a dispensing pump and an electronic system which is clip-on over the dispensing pump. The electronic system includes a processing unit, a sensor unit, a memory unit and a communication unit.

The present invention also provides an auxiliary system of a dispensing system having a fluid container. The dispensing pump includes a memory unit having a plurality of instructions and information pertaining to the fluid contained in the fluid container, stored therein; a sensor configured to detect dispensing of fluid from the fluid container; and a processing unit in communication with each of the sensor and the memory unit. The processing unit is adapted to process the set of instructions stored in the memory unit to determine quantity of fluid dispensed from the container, upon receiving a signal from the sensor.

Figure 1:
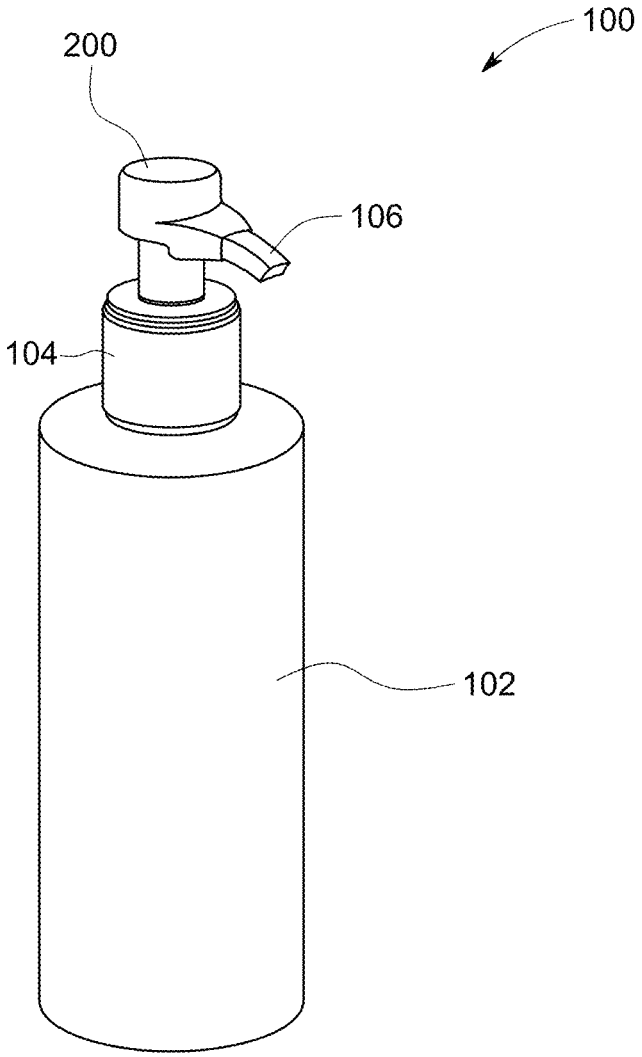
FIG. 1 illustrates a perspective view of the dispensing system, in accordance with an embodiment of the present invention.

Referring to FIG. 1, a perspective view of a dispensing system 100 is illustrated. The dispensing system 100 includes a fluid container 102 and a dispensing pump 104. The fluid container 102 may be configured to store fluids including, but not limited to soap, sanitizer, or moisturizer etc. The fluid container 102 has predefined storage capacity. The fluid container 102 has a predetermined shape for holding a predetermined volume of fluid. In the illustrated example, the fluid container 102 is a cylindrical container. Alternatively, the fluid container 102 may have any shaped container configured to store fluid, without limiting the cylindrical shape as illustrated.

The fluid container 102 may be a disposable or refillable dispensing container, portable container or any other type of container as suitable per user's requirement. In the illustrated example, the fluid container may be made of plastic material. Alternatively, the fluid container may be made from materials such as glass, metal, resin etc. without any limitations. One end of the fluid container 102 comprises a threaded portion (not shown). The threaded portion is adapted to receive the dispensing pump 104. The dispensing pump 204 is threadably coupled to the fluid container 102 for delivering an amount of fluid stored therein. In the illustrated example, the dispensing pump 104 is operated manually. Alternatively, the dispensing pump 204 may be operated automatically or semi-automatically, without any limitations.

The dispensing pump 104 comprises a collar neck, a pump member (not shown), and spout 106. The collar neck is threadably coupled to the threaded portion of the fluid container. The pump member extends through the collar neck into the fluid container. One end of the pump member lies within the fluid container 102 and another end of the member is coupled to the spout 106. The spout 106 is adapted to be depressed or pressed to release the fluid contained within the fluid container 102.

Figure 2:
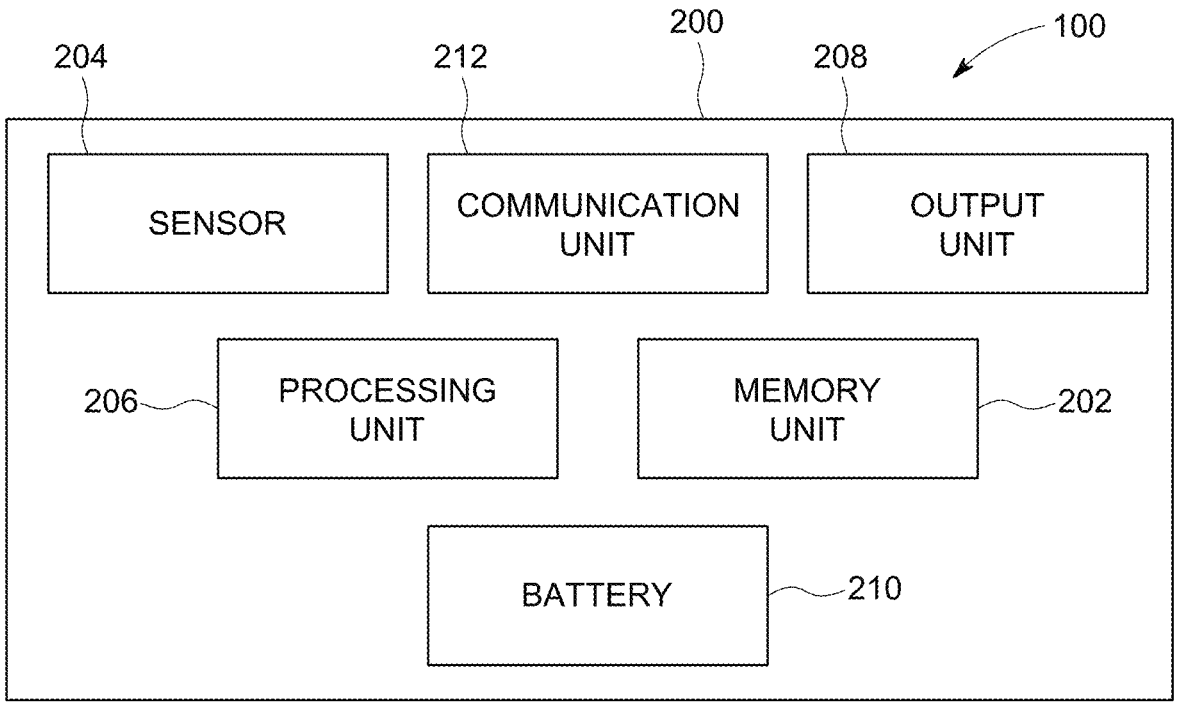
FIG. 2 illustrates a block diagram of the electronic part integrated at the a dispensing system, in accordance with an embodiment of the present invention.
Figure 3:
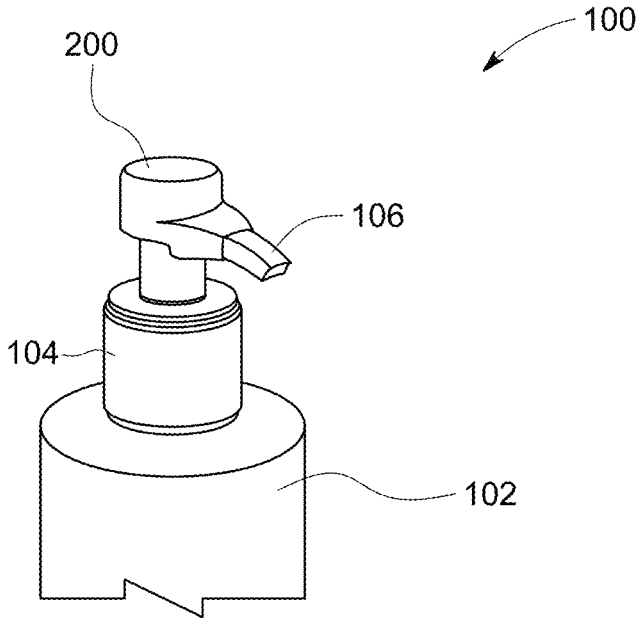
FIG. 3 illustrates a perspective view of the dispensing system, in accordance with an embodiment of the present invention.
Figure 3A:
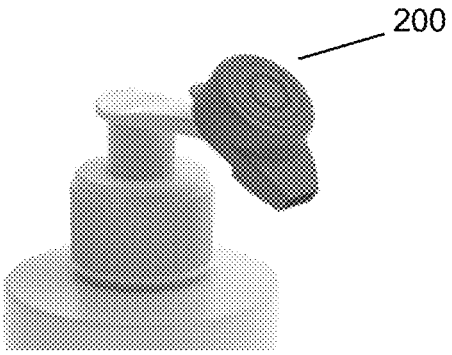
FIG. 3A illustrates a perspective view of the dispensing system with a clip-on option, in accordance with an embodiment of the present invention.

Referring to FIGS. 1 and 2, the dispensing system 100 further includes an auxiliary system 200. In an embodiment, the auxiliary system 200 may be a smart electronic chip member and may be disposed on the spout 106. The auxiliary system 200 may be integrally formed with the spout 106. The auxiliary system 200 is configured to detect the amount of fluid being dispensed from the fluid container 202. As shown in FIG. 3A, in an example, the auxiliary system 200 may be a clip-on type, and can be fitted onto top of the spout 106.

The auxiliary system 200 comprises a memory unit 202, a sensor 204, a processing unit 206, an output unit 208, a battery 210 and a communication unit 212. The memory unit 202 is configured to store a plurality of instructions and information pertaining to the fluid contained in the fluid container 102. In an embodiment, the information pertaining to the fluid contained in the fluid container 102, includes quantity or volume of fluid initially filled in the fluid container 102, and storage capacity of the fluid container 102 etc.

The sensor 204 is configured to detect dispensing of fluid from the fluid container 102. The sensor 204 is also configured to provide a signal of such detection. In an embodiment, the sensor 204 detects pressing of the spout 106 by a user and simultaneously send a corresponding signal. The sensor 204 may be and not limited to a touch sensor, a pressure sensor, an electronic switch, or a strain gauge or any kind of sensor which can be used to determine the amount of fluid being dispensed, without any limitations.

The battery 210 is configured to supply predetermined power to various units of the auxiliary system 200. In an embodiment, the battery 210 may be a rechargeable battery providing requisite power to one of more of the memory unit 202, the sensor 204, the processing unit 206, and the output unit 208.

The processing unit 206 is in communication with each of the sensor 204 and the memory unit 202. The processing unit 206 is adapted to process the set of instructions stored in the memory unit 202 to determine quantity of fluid dispensed from the fluid container 102, upon receiving the signal from the sensor 206. In an embodiment, the processing unit 206 is adapted to calculate a current quantity of fluid in the fluid container 102 based on the comparison between the quantity of fluid dispensed from the fluid container 102 and the quantity of fluid stored in the fluid container 102.

Further, the processing unit 206 is adapted measure passage of time upon receiving the signal from the sensor 206, and provide an output upon passage of a predetermined period of time, via the output unit 208. In an embodiment, the predefined period of time after which the processing unit 206 causes the output unit 208 to provide an output may be 10 seconds. Alternatively, the predefined period of time after which the processing unit 206 causes the output unit 208 to provide an output may be higher than 10 seconds, say 1 hour, with an intention to remind the user to wash the hands.

Therefore, owing to the communication with and information received from the memory unit 202 and the sensor 206, the processing unit 206 keeps track of the amount of fluid remaining in the fluid dispenser 102, amount of fluid dispensed from the fluid dispenser 102.

Further, the processing unit 206 is adapted to send a communication signal based on the calculation to the communication unit 212 and the output unit 208. The communication unit 212 is configured to receive the communications signal from the processing unit 206 and communicate the processed data over the communication network. The communication unit 212 may include, but not limited to Bluetooth, Wi-Fi, NFC devices, Cellular communication, etc. The processed signals received via the processing unit 206 may include instruction pertaining to replenishing the fluid into the fluid container 102.

In an embodiment, the communication unit 212 connects the communications signal from the processing unit 206 to online shopping portals to re-order the fluid when it is about to be consumed completely. Alternatively, in an embodiment, the communication unit 212 connects the communications signal from the processing unit 206 to a user device, such as a smartphone, allowing the user to manually order on receiving the message about the complete consuming of the product. The processing unit 212 further communicates with the brand and the brand may further connect with the consumers with various offers to convince them to re-order or re-use the product.

Further, the processing unit 206 with the help of communication unit 212 may be able to communicate with a software application. Thus, sending the usage pattern of the product to the users. Sending messages to use the pump. The users are able to view usage data and analytics.

The output unit 208 receives input from the processing unit 206 and outputs signals on receiving input from the processing unit 206. The output unit 208 may include, but not limited to, LED, Speakers, Vibrators and any combination thereof. The output, via the output unit, may be one or more of audio output, visual output, or tactile output. In an example, the output unit 208 on receiving command from the processing unit 206 shows light indications, blink to acknowledge the usage of product for a pre-determined time. Make sounds or play music for the pre-determined time during the recommended usage of the product.

Figure 4:
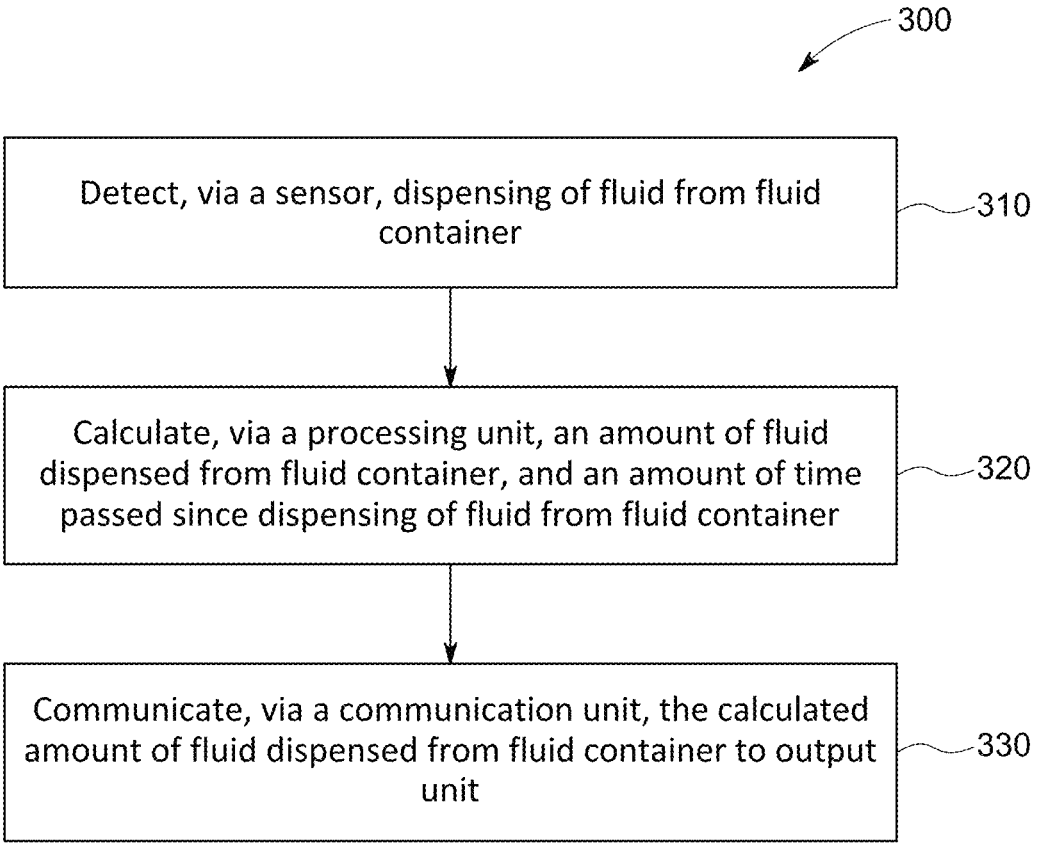
FIG. 4 illustrates a block diagram of a method of operating a dispensing system, in accordance with an embodiment of the present invention.

Referring now to FIG. 4, where a method of operating a dispensing system 300, in accordance with an embodiment of the present invention, is illustrated. The method 300, at 310, includes detecting, via a sensor, dispensing of fluid from a fluid container. The method 300, at 320, includes calculating, via a processing unit, an amount of the fluid dispensed from the fluid container, and an amount of time passed since dispensing of fluid from the fluid container. The method 300, at 330, includes communicating, via a communication unit, the calculated amount of fluid dispensed from the fluid container to the output unit.

The method 300 further includes comparing the calculated amount of fluid dispensed from the fluid container with the predefined storage capacity of the fluid container to determine an amount of fluid left in the fluid container. The method 300 further includes providing an output after passage of a predetermined duration of time since dispensing of fluid from the fluid container.

In light of the foregoing the dispensing system 100, and the auxiliary system 200 of the dispensing system 100, provides various advantages and improvements over existing art. In particular, the present invention offers various advantages such as helping in maintaining hygiene of users. The present invention may be attached to a soap dispenser and thus encourage users to wash hands on regular basis. Further, the present invention reminds the user to wash hands for a pre-defined seconds (e.g. 10 seconds) with accurate amount of the soap required for cleaning. Further, the present invention is able to communicate over a communication network and thus keeps the user informed with various associated data The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present invention.

What is claimed is:

1. A dispensing system comprising:

a fluid container adapted to store a fluid, the fluid container having a predefined storage capacity, wherein the fluid container comprises a threaded portion;

a dispensing pump having a collar neck, a pump member, and a spout, wherein the collar neck is threadably coupled to the threaded portion of the fluid container; and a clip-on device to be fitted onto a top of the spout, the clip-on device having, a memory unit having a plurality of instructions and information pertaining to the fluid contained in the fluid container, stored therein;

a sensor configured to:

detect dispensing of fluid from the fluid container and to provide a signal of such detection, and detect pressing of the spout by a user and simultaneously sending a corresponding signal; and a processing unit in communication with each of the sensor and the memory unit, wherein the processing unit is adapted to:

process the set of instructions stored in the memory unit to determine quantity of fluid dispensed from the fluid container, upon receiving the signal from the sensor, measure passage of time upon receiving the corresponding signal from the sensor to provide an output after passage of a predetermined period of time;

compare a quantity of fluid dispensed from the fluid container and a quantity of fluid stored in the fluid container, calculate a current quantity of fluid in the container based on the comparison, and wherein the processing unit is adapted to calculate last replenishment time of fluid in the container.

2. The dispensing system of claim 1 further comprises a communication unit, wherein the processing unit is adapted to process the set of instructions stored in the memory unit and send processed signals to the communication unit.

3. The dispensing system of claim 2, further comprises an output unit adapted to receive signals received from the processing unit via the communication unit, wherein the processed signals include instruction pertaining to replenishing the fluid into the fluid container.

4. The dispensing system of claim 3, wherein the output upon passage of the predetermined period of time, via the output unit, is one or more of audio output, visual output, and tactile output.

5. The dispensing system of claim 3 further comprises a battery unit to provide power to the memory unit, the sensor, processing unit, and the communication unit.

6. An auxiliary system of a dispensing system having a fluid container including threaded portion, and a dispensing pump, the dispensing pump having a collar neck, a pump member, and a spout, wherein the collar neck is threadably coupled to the threaded portion of the fluid container, the auxiliary system comprising:

a clip-on device to be fitted onto a top of the spout, the clip-on device having:

a memory unit having a plurality of instructions and information pertaining to the fluid contained in the fluid container, stored therein;

a sensor configured to:

detect dispensing of fluid from the fluid container, and to provide a signal of such detection; and detect pressing of the spout by a user and simultaneously sending a corresponding signal; and a processing unit in communication with each of the sensor and the memory unit, wherein the processing unit is adapted to:

process the set of instructions stored in the memory unit to determine quantity of fluid dispensed from the container, upon receiving a signal from the sensor, and measure passage of time upon receiving the corresponding signal from the sensor to provide an output after passage of a predetermined period of time;

compare a quantity of fluid dispensed from the fluid container and a quantity of fluid stored in the fluid container, calculate a current quantity of fluid in the container based on the comparison, and wherein the processing unit is adapted to calculate last replenishment time of fluid in the container.

7. The auxiliary system of claim 6 further comprises a communication unit, wherein the processing unit is adapted to process the set of instructions stored in the memory unit and send processed signals to the communication unit.

8. The auxiliary system of claim 7, further comprises an output unit adapted to receive signals received from the processing unit via the communication unit, and wherein the processed signals include instruction pertaining to replenishing the fluid into the fluid container.

9. The auxiliary system of claim 7 further comprises a battery unit to provide power to the memory unit, the sensor, processing unit, and the communication unit.

10. The auxiliary system of claim 8, wherein the output upon passage of the predetermined period of time, via the output unit, is one or more of audio output, visual output, and tactile output.

11. The dispensing system of claim 2, further comprises an output unit adapted to receive signals received from the processing unit via the communication unit, wherein the processed signals include instruction pertaining to usage pattern of a plurality of components of the dispensing system.

* * * * *